United States Patent [19]

Blanchard

[11] Patent Number: 4,734,942

[45] Date of Patent: Apr. 5, 1988

[54] LAVATORY SEATS WITH AUTOMATIC CLEANING OF THE BOWL

[76] Inventor: Claude G. A. Blanchard, 5, rue de la Fontaine - Colombier-Chatelot, 25260 Colombier-Fontaine, France

[21] Appl. No.: 787,980

[22] Filed: Oct. 16, 1985

[30] Foreign Application Priority Data

Oct. 19, 1984 [FR] France ..... 84 16231

[51] Int. Cl.[4] ..... A47K 13/30

[52] U.S. Cl. ..... 4/233

[58] Field of Search ..... 4/233

[56] References Cited

U.S. PATENT DOCUMENTS

| | | | |
|---|---|---|---|
| 2,672,622 | 3/1954 | Foster | 4/227 |
| 3,599,246 | 8/1971 | Bramati | 4/233 |
| 4,536,899 | 8/1985 | Schnyder | 4/233 |

FOREIGN PATENT DOCUMENTS

| | | | |
|---|---|---|---|
| 52034 | 2/1911 | Austria | 4/233 |
| 0035962 | 2/1981 | European Pat. Off. . | |
| 214183 | 10/1909 | Fed. Rep. of Germany | 4/233 |
| 510241 | 10/1930 | Fed. Rep. of Germany | 4/233 |
| 7017438 | 6/1972 | Netherlands . | |
| 83870 | 7/1935 | Switzerland | 4/233 |
| 306955 | 7/1955 | Switzerland . | |
| 12200 | of 1906 | United Kingdom | 4/233 |
| 375167 | 6/1932 | United Kingdom . | |

*Primary Examiner*—Charles E. Phillips

*Attorney, Agent, or Firm*—Balogh, Osann, Kramer, Dvorak, Genova & Traub

[57] ABSTRACT

Sanitary installation. The lavatory seat comprises:

- a bowl comprising on its upper rim, support and guiding means which are interrupted,
- a seat formed by a closed ring mounted on said means,
- a unit for cleaning the peripheral surface of the seat,
- a driving member for driving the seat in a sliding movement on the means,
- and means for controlling:
  - the operation of the unit, and
  - the supply of the motor conjugated to the operation of the unit, Application to lavatory seats with incorporated flush tank.

15 Claims, 7 Drawing Sheets

LAVATORY SEATS WITH AUTOMATIC CLEANING OF THE BOWL

The present invention relates to a lavatory unit, constituted by a bowl with an annular seat, and it relates more particularly to those lavatories equipped with means for automatically cleaning the annular seat.

Although the lavatories with seats undeniably offer real comfort to the user, they on the other hand present certain risks of pollution or contamination especially in the case of sanitary installations for public or communal use.

In order to reach a perfectly normal level of hygiene, various solutions have been proposed for cleaning and disinfecting the lavatory bowl.

German Pat. No. 252 298 for example, has proposed to equip the lavatory seat with a device in the form of a vertical casing comprising on the inside, means of endlessly moving two lavatory seats one after the other, which seats can be, successively, adapted over the lavatory bowl and placed relatively to a cleaning station situated inside the casing.

This first proposition was found to solve the existing problem to a certain extent, but from the technical standpoint it was not found to be really satisfactory for a number of reasons.

First of all, the casing and technical means for endlessly moving two lavatory seats one after the other make up a rather cumbersome assembly which is somewhat complex and not readily adaptable or fittable in the premises normally used for housing public conveniences.

Secondly, the cleaning and disinfecting of the lavatory seat are not fully and satisfactorily performed due to the shape which such seats normally have. The initially planned cleaning operation is only partly completed and leaves much doubt as to the cleanliness of the installation.

Thirdly, according to the solution proposed by the aforesaid patent, it is the user who has to control by hand the operation of the assembly whereby the used lavatory seat is retracted and replaced by a clean one.

In the case of installations for public or communal use, it is rare, if ever, when a user just leaving the public convenience, has performed the necessary cleaning operation, so that the following user may have to do it himself if he wants to use a clean seat.

One other solution which has been proposed consists in sheets of paper or the like being supplied to the users from dispensing means, the said sheets being cut so as to be placed over the seat.

Not surprisingly, such a solution cannot be very satisfactory, especially in the case of public conveniences, seeing that, besides the necessity to keep the dispensing means supplied, there remains the problem of pollution and contamination of the lavatory seat as a whole.

Another solution is also taught from French Pat. No. 75 21636 which is inspired from the solution proposed by German Pat. No. 252 298.

This solution is not satisfactory either because the installation needed is much more complex and as a result more expensive, cumbersome and more unreliable in its functioning.

The same reservations must be made concerning French Patents of Addition 76-07790, 76-28533, 77-04863 and 77-22145.

European Patent Application No. 0 092 481 is also known to describe a public convenience installation which is equipped with a bowl-cleaning assembly, this assembly being also inspired from the initial teaching given in German Pat. No. 252 298.

The solutions proposed in the aforesaid European Patent are particularly complex and as a result, they are delicate to carry into effect. The recommended technical means invariably lead to a very expensive installation, of doubtful reliability, due to its large number of constituting elements and of disproportionate size, which is generally unsuitable for installation in sanitary premises such as for example for public or communal use.

The prior art also proposes other solutions based on a different technique which, in its general principle, consists in making the seat rotatable in order to have it go through a cleaning unit fixed on the rear part of the bowl.

One prior publication which would appear to be the most appropriate and the least cumbersome proposition to settle the arising problem, is Netherland Pat. No. 7 017 438. According to said patent, it is recommended to mount a circular guide rail on the edge of the lavatory seat, and to fit over said rail a seat of complementary profile, which defines on the inside, a rack engaged with a driving pinion carried by the output shaft of an electric motor mounted on the bowl. The lavatory seat goes through a cleaning and drying unit, the technical means of which are not expressly defined.

The teaching procured by such document could be deemed as the answer to the arising problem, insofar as the analysis made of it remains limited. But in reality, said proposition is not satisfactory for the following reasons.

First of all, the necessity to interpose a rail raises important problems of adaptation to and fitting on the existing designs of lavatory pans. Such a rail furthermore represents a profile with great expanse of contacting surfaces, which is not really adapted to a supple sliding movement with little friction. Therefore there is an important problem of mechanization to solve.

Then, the delimitation of an external rack system implies, for sanitary reasons, designing the lavatory seat so as to cover up the rack and make it inaccessible. This has at least two negative consequences. The first one resides in the greater width given to the seat, and consequently to the means which have to be provided on the bowl to support it. The second resides in the difficulty, if not impossibility, of cleaning such a design of the seat.

Finally, the proposition whereby a cleaning unit should be used, without specifying the means of it, is a puzzle to anyone skilled in the art. Indeed, such unit may be formed of spongy cleaning and drying masses which surely cannot be an efficient, practical and lasting solution. Or else, such unit may comprise means of dispensing disinfectant liquid products, in which case, there is no indication of any guarantee of an efficient drying. It should also be noted that, in such a case, no information is given as to how to avoid projections, dripping and trickling of the liquid product.

In actual fact, said patent only gives a teaching about the mechanization of the lavatory seat, and does not in fact give an answer to the real problem raised which is that of ensuring with efficiency and without surrounding pollution, the disinfection and cleaning of a lavatory seat after every use, and this automatically and reliably.

It is the object of the present invention to overcome the disadvantages presented by the currently known solutions, by proposing a new lavatory seat complete with means to automatically clean the bowl of the seat.

The new lavatory seat according to the invention is designed so as to guarantee the cleaning and disinfecting of the lavatory bowl over the entire peripheral surface thereof, thus meeting the hygiene standards which the users expect to find in sanitary installation of a private, public or communal nature.

The lavatory seat according to the invention is moreover designed so as to form an assembly having the same overall size as the lavatory seats with supported flushing tanks, thus permitting an easy and rapid installation on any type of premises.

The lavatory seat according to the invention is also designed so as to be able to control the cleaning and disinfecting of the lavatory bowl, regardless of the type of energy or the draining system used, namely whether it be a lavatory with water-flushing effect, or grinding effect or with chemical decomposition means, etc . . .

The lavatory seat is furthermore designed so that the cleaning/disinfecting function automatically represents the final phase of the use made of it, thus guaranteeing decontamination and cleanliness of the lavatory bowl for the next user.

The lavatory seat according to the invention is also designed so as to perform the cleaning/disinfecting operation even when the seat/bowl installation is made with dissociation and local implantation at a distance of one or more tanks for delivering a flushing and/or disinfecting liquid, which may be water for the flushing effect or an antiseptic cleaning mixture for washing the bowl and controlling the opening of a draining flap, etc . . .

The lavatory seat is finally designed so as to permit a cleaning/disinfection function, without any splashing of liquid and with direct elimination of the cleaning products through the excreta-flushing circuit. The lavatory seat according to the invention, which is of normal overall size can also be installed without the necessity of installing an external piping system, or surfaces, containers or cavities for receiving and retaining the draining flows of cleaning products.

To attain these objects, the invention is characterized in that it comprises:

- a bowl provided, on its upper rim, with support and guiding means, which are an integral part of the bowl and are interrupted at least partly, and locally, in the part substantially corresponding to a back portion of the bowl,
- a seat formed by a closed ring offering through its lower face a structure complementary to the means on which said structure is removably adapted with sliding possibility,
- at least one small basin presented by the back portion of the bowl in the means interruption zone, and communicating with a draining channel issuing into the bowl,
- a cleaning unit for the peripheral surface of the bowl, which unit is situated in the means interruption zone and at least partly plumb with the small basin,
- a driving member placed in the means interruption zone, and designed to cause the seat to slide over through said zone and unit, and means for controlling:

- the temporary working of the unit,
- and the conjugated supply of the driving member in order to cause the movement of the seat with respect to said unit over at least a complete round.

The invention will be more readily understood on reading the following description with reference to the accompanying drawings in which.

Figure 1:
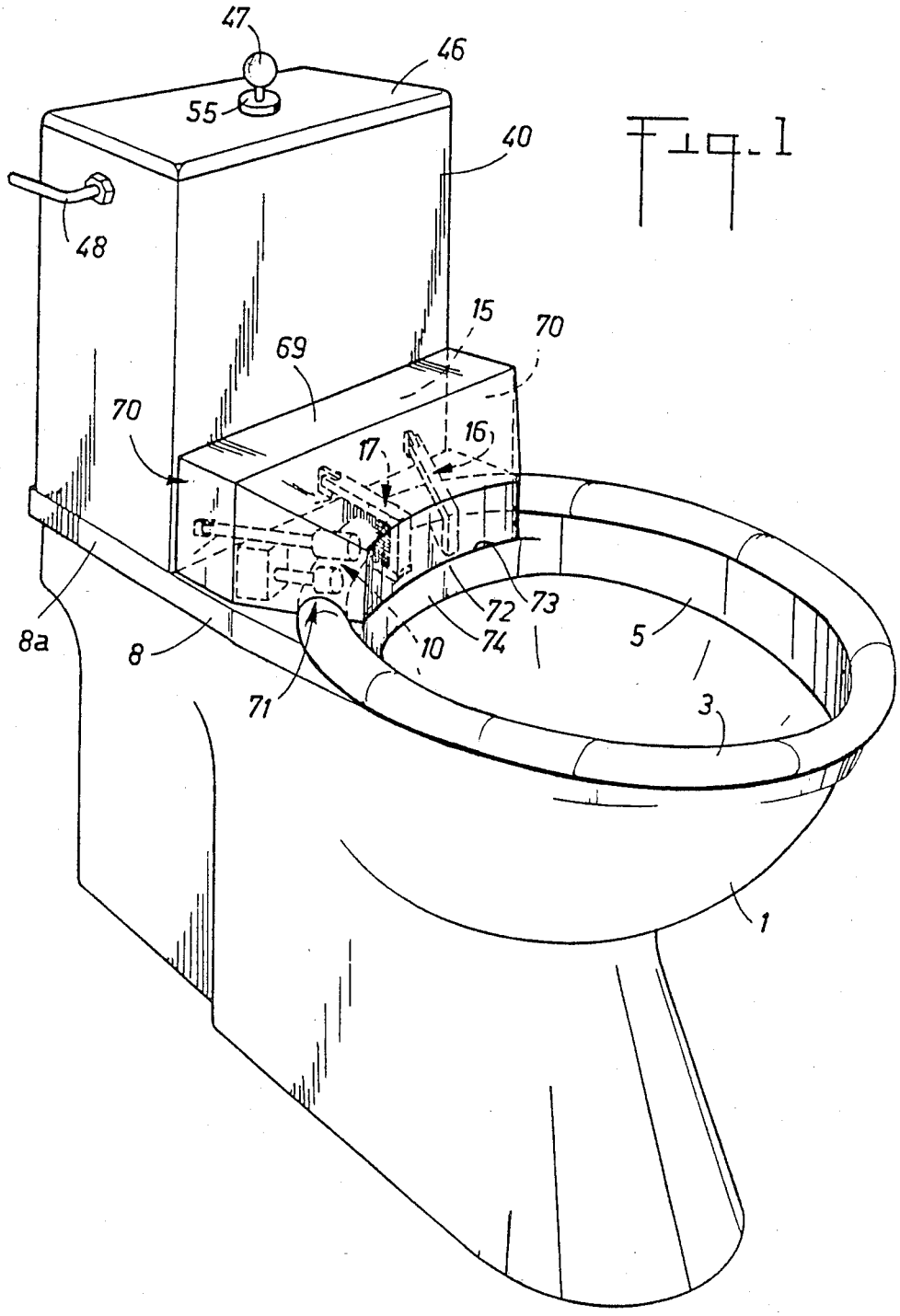
FIG. 1 is a perspective view of the object of the invention.
Figure 2:
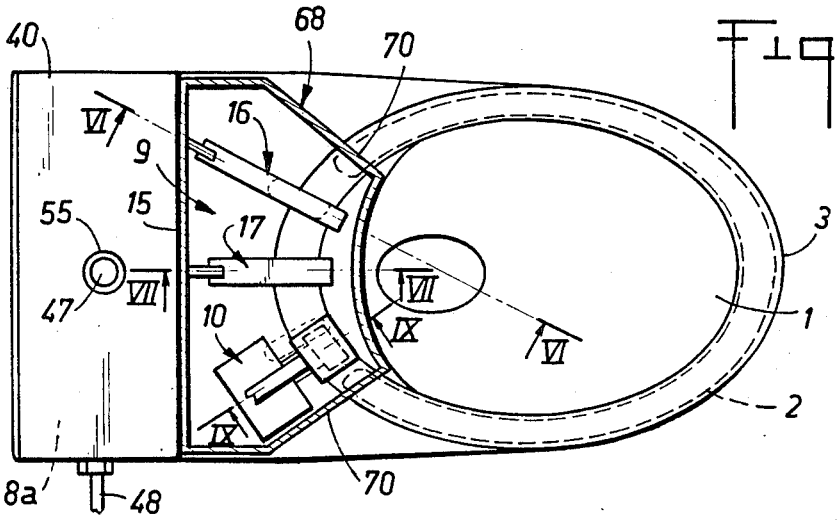
FIG. 2 is a plan view, partly in cross-section, corresponding to FIG. 1.
Figure 3:
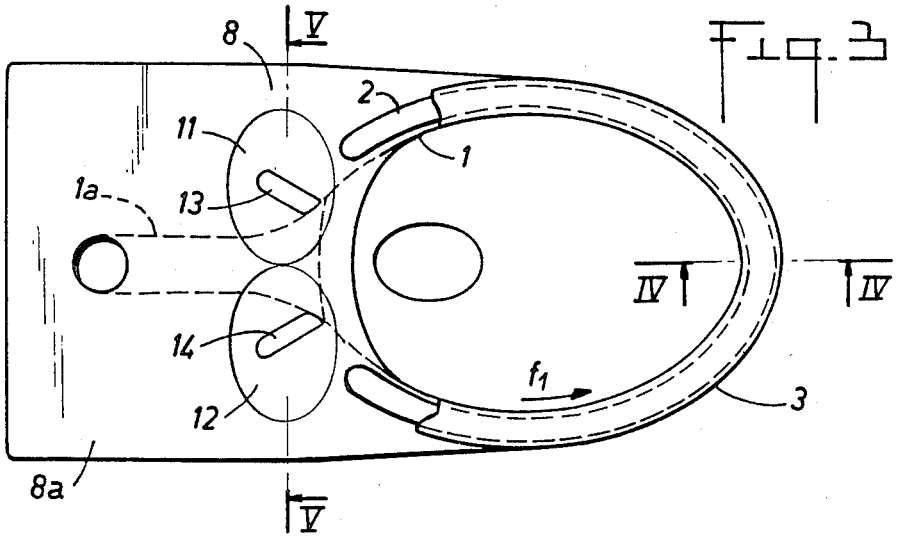
FIG. 3 is a plan view, similar to FIG. 2, but illustrating different embodiment details.

Referring first to FIGS. 1 to 3, these show that the object of the invention is a lavatory seat 1, of the type with a bowl, which is comparable to any conventional type of toilet bowl.

According to the invention, the upper edge of said bowl is designed so as to include means 2, which are an integral part of the bowl for supporting and guiding a complementary seat 3, which is formed by a closed ring mounted for possible sliding, for example in the direction of arrow $f_1$. According to FIGS. 1 to 3, the bowl 1 has, in its upper plane, an oval geometrical shape. It must be noted that a circular shape is also acceptable according to the invention. In the case of the illustrated oval construction, the closed ring element constituting the seat 3 is produced from an elastically deformable material, capable of adapting to the curving variations imposed by the means 2 with which they cooperate when said ring element moves inside its plane in the direction of arrow $f_1$.

Figure 4:
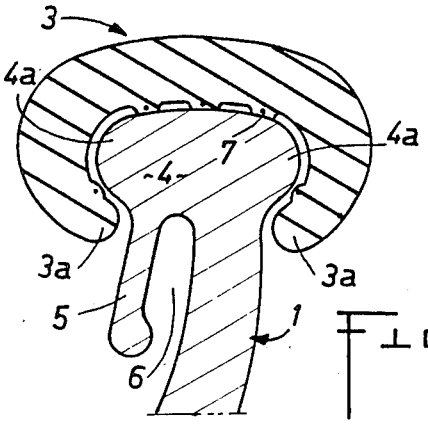
FIG. 4 is a cross-section on a larger scale along line IV—IV of FIG. 3.

According to the embodiment illustrated in FIG. 4, the means 2 are constituted by a flange portion 4 which is formed by the projecting upper rim of the bowl, and is interrupted locally in the part corresponding substantially to the back of the bowl. Such local interruption can for example cover an angular area substantially equal to 90° centered on the corresponding center in the case of the oval embodiment illustrated in FIG. 3, or to about 60° centered on the center of the bowl, in the case of a circular embodiment thereof. FIG. 4 shows that the flange portion 4 can be formed so as to be integral with a peripheral covering 5 representing a channel or drain 6. As is normally the case with lavatory bowls, the covering 5 and drain 6 enable to avoid any projections of the cleaning, desinfecting and/or flushing fluid and to cause said fluid to spread over the entire inner periphery of the bowl, thus ensuring the cleaning of all its surface.

When the means 2 are constituted, as indicated hereinabove, by a flange portion 4, the closed ring constituting the seat 3 is, for example, produced in the form of a C-shaped section. Said ring can thus be fitted over the flange portion 4, in such a way that its longitudinal edges 3*a* come into engagement under shoulder members 4*a* formed by said flange portion 4. The edges 3*a* and shoulder members 4*a* create means of relative immobilization crosswise, holding the ring 3 in position on the flange portion 4, whilst leaving to said ring a possibility of being released or removed for ready replacement, if necessary.

FIG. 4 shows that the inner peripheral face of said ring 3 comprises projecting ribs 7, which may be reinforced and are designed to rest against the surface of the flange portion, thus acting as friction reducing sliding members.

The seat 3, which is in the form of a closed ring of C-shaped cross-section, is thus fitted over the means 2 with respect to which it can turn for example in the direction of arrow $f_1$, whilst being moved in guided manner with respect to the means 2 supporting it.

Said lavatory seat 3 can thus be caused to traverse, by its entire perimetric length, the local interruption zone of the means 2, by extending, through said interrupted part, in parallel to the upper surface of a flat back portion 8 formed by the top of the bowl 1. To help with the support and displacement of the seat 3, it is possible to include punctual supports in the interruption zone of means 2.

Figure 5:
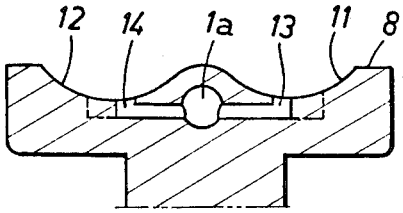
FIG. 5 is a cross-section on a different scale along line V—V of FIG. 3.

The back portion 8 supports a cleaning unit 9 and a driving member 10 controlling the sliding movement of the seat 3 with respect to the means 2, for example in the direction of arrow $f_1$. The cleaning unit 9 and driving member 10 are situated substantially just above two depressions 11 and 12 which are formed (FIG. 5) in the portion 8, in the zone of interruption of the means 2. The depressions somehow constitute, widely open funnels or basins which communicate, respectively via a hole 13 or 14, with the flowing channel 1*a* provided in the bowl 1 for the bowl-cleaning liquid. Depending on the type of lavatory, said liquid can be a mixture of disinfecting products, or else water distributed, in known manner, so as to give a flushing effect.

The unit 9 and driving member 10 are carried by the bowl so that they are placed in the local interruption zone of the means 2. To this effect, they can either be fixed directly on the portion 8 or be carried by a plate 15 adaptable on the portion 8 by conventional removable fastening means.

The cleaning unit 9 comprises means 16 for dispensing a disinfectant product, and means 17 for ensuring the elimination of the product coming from a tank.

Figure 6:
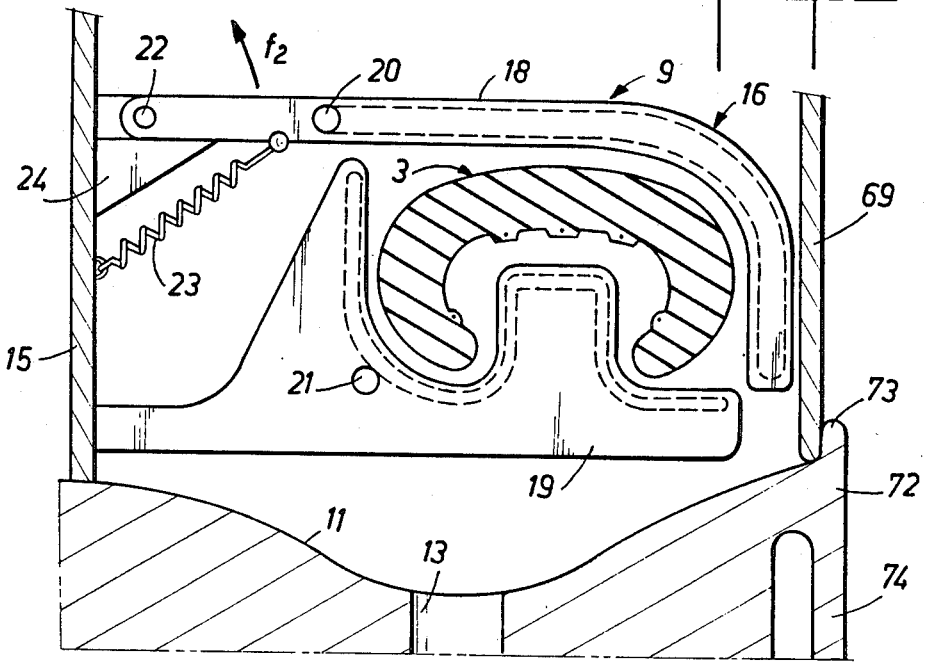
FIGS. 6 and 7 are partial cross-sections on a larger scale, along lines VI—VI and VII—VII of FIG. 2.

According to the embodiment illustrated in FIG. 6, the means 16 for dispensing the disinfectant product are of the spraying type. The means 16 comprise two tubular ramps 18 and 19, so shaped as to surround the cross-section of the ring constituting the seat 3. Ramps 18 and 19 are preferably fixed on the plate 15 and are joined, via couplings 20 and 21, to feed pipes feeding in a liquid disinfectant under pressure. Different means of feeding in the product may be envisaged, from a storage means not shown in FIG. 6, but forming part of the unit 9 and which can be situated at some distance therefrom or be incorporated thereto. Whatever the case, ramps 18 and 19 are fed intermittently according to a cycle of use such as described hereinafter.

Preferably, the ramp 18 is mounted on a pivot pin 22, which is for example horizontal, so as to move in the direction of arrow $f_2$ against the action of an elastic return member 23 whose task is to keep the ramp 18 always in a stable position against a stop member 24. The mounting method described hereinafter enables, whenever necessary, to lift the ramp 18 to allow the release and removal of the closed ring, when the object is to dismount said ring from the means 2, if the ring needs changing due to damage or wear.

Figure 7:
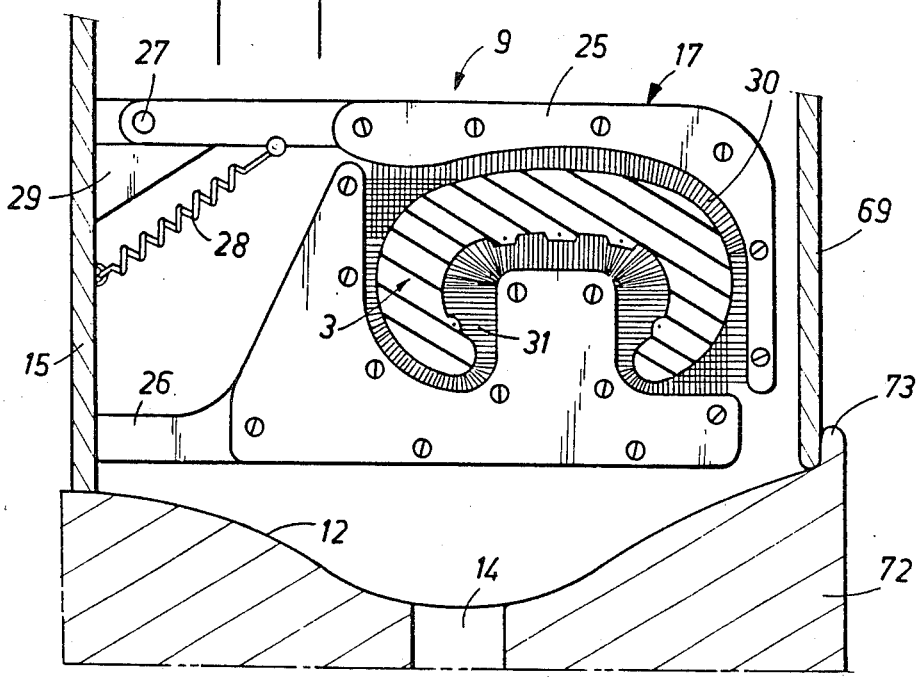

The means 17 for removing the disinfectant product, as illustrated in FIG. 7, comprise two scraper supports 25 and 26 of substantially the same shape as the ramps 18 and 19, to surround the cross-section of the closed ring 3. Said scraper supports 25 and 26 are mounted in the same way as described hereinabove for ramps 18 and 19 and they are also, for example, carried by the plate 15. For the same reasons as above, the scraper support 25 is mounted for pivoting on a pivot pin 27 always against the action of an elastic member 28 urging it to occupy a stable position against a stop member 29.

Figure 8:
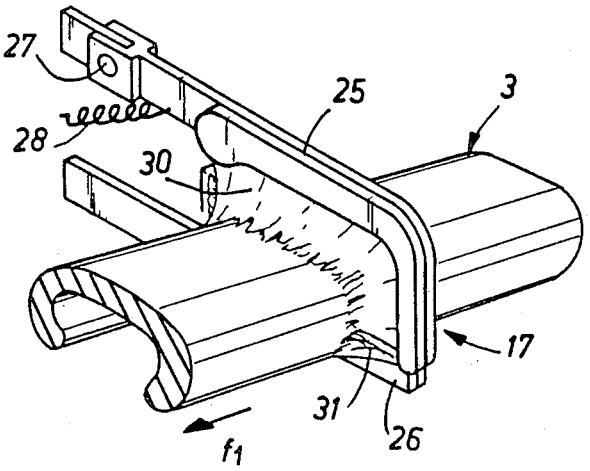
FIG. 8 is a partial perspective showing up an embodiment detail of one of the constitutive elements shown in FIG. 7.
Figure 9:
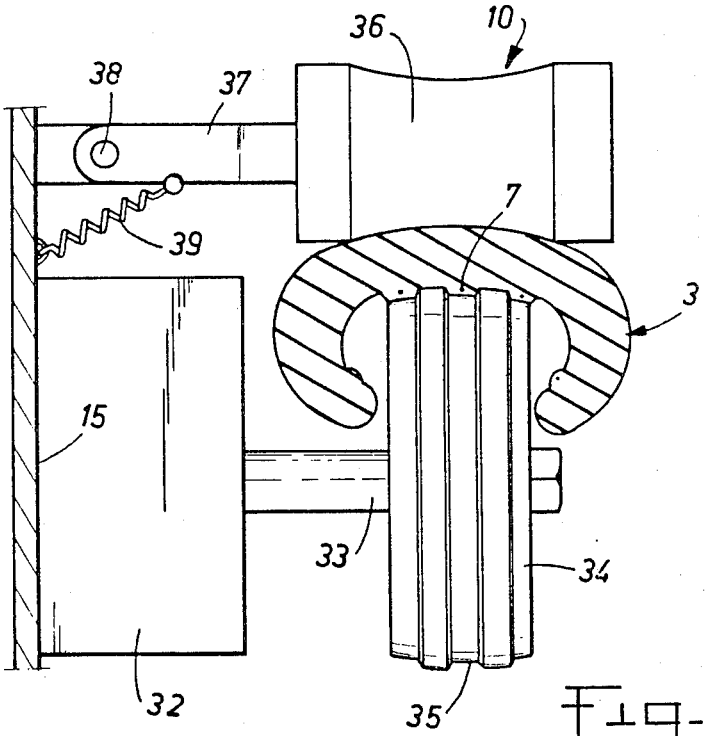
FIG. 9 is a partial cross-section on a larger scale along line IX—IX of FIG. 2.

The scraper supports 25 and 26 are equipped with pads 30 and 31 wiping the whole transverse periphery of the outline of ring 3. Said pads 30 and 31 can be made up of hairs, fibers or scrapers, preferably in elastomer. In such a case, it is advantageous, as illustrated in FIG. 8, to incline the scrapers in the moving direction (arrow $f_1$) followed by the ring 3, thus making sure that the pads are firmly applied over the whole transverse periphery of the ring.

The means 16 and 17, described hereinabove, are preferably disposed in a substantially radial direction with respect to the part of ring 3 which traverses the interruption zone of the support and guide means 2.

In certain cases, a plurality of pairs of scraper supports are provided one next to the other in order to form means 17.

The driving member 10, moving the ring 3 over the means 2, comprises a motor 32 which can be of the water or electric type. Said motor 32 is adapted on the portion 8, or preferably, it is removably fixed on the plate 15. The output shaft 33 of motor 32 is equipped with a driving roller 34 placed such as to be in permanent contact with the surface of ring 3, whilst being for example engaged into the section defined by the latter. Said driving roller 34 can comprise grooves 35 meshing with the ribs 7 provided on the ring 3. The driving member 10 further comprises a reverse pad-roller 36 mounted for turning freely on a shaft 37 secured via a horizontal pivot pin 38 on the plate 15. The shaft 37 is urged by a spring 39 whose task is to keep the reverse roller 36 pressed against the top of the ring 3, which latter is itself pressed against the periphery of the driving roller 34. FIG. 2 shows that the drive member is placed against the means 16 and 17, so that the output shaft 33 extends, preferably, in a substantially radial direction with respect to the part of ring 3 which goes through the interruption zone of the means 2.

Means, described hereinafter, are provided to start the unit 9 and driving member 10 working whenever, after use, the user controls the rinsing and cleaning of the bowl. Such means are automatically actuated when the user operates the control provided to this effect, for cleaning or flushing the bowl.

Said means then feed the ramps 18 and 19 which are designed to spray the whole periphery of the ring 3 with the disinfectant product provided to this effect and brought up to the ramps via couplings 20 and 21.

Said means ensure the conjugated supply of the motor 32 which drives the driving roller 34 in rotation, this cooperating with the reverse pad-roller 36 to cause the sliding of the ring 3 over the means 2. The movement caused, for example in the direction of arrow $f_1$, results in the whole perimetric length of the closed ring 3 moving with respect to the ramps 18, 19 which dispense the disinfectant product over the whole periphery of the ring 3. The movement in the direction of arrow $f_1$ also causes the displacement of the peripheral surface of ring 3 through the wiping means 17, beyond which said surface is found in a dry state, clear of any product. Any excess of disinfectant product dispensed by the ramps 18 and 19, as well as any product scraped off or wiped off by the means 17, fall by gravity into basins 11 and 12 to be subsequently removed through the draining channel 1*a*. Any traces or drops left on the side of the driving member 10 also fall by gravity into the basin 12.

The means controlling the operation of the unit 9 and the conjugated supply of the motor 10 are regulated so that the roller 34 causes the closed ring 3 to move in front of the unit 9 over a length at least equal to its perimetric measurement, namely normally over at least one turn. Thus the whole upper and lower surface of the ring 3 undergoes a spraying-cleaning and wiping operation which guarantees a perfect disinfection of all that part which is visible when the ring is returned to a stable position, once the motor 32 has stopped. The user can thus use, in all safety a lavatory seat with a maximum of asepsy and which is free of all pollution or contamination.

According to a preferred embodiment of the invention, the driving member 10 is situated, taking into account the moving direction indicated by arrow $f_1$, so as to be placed downstream with respect to the cleaning unit 9. In this way, the driving roller 34 and the reverse pad-roller 36 are protected against any risk of pollution or contamination.

The means used for controlling the operation of the unit 9 and the feeding of the driving member 10 can be any types. These can be electric pumps, whose task is to draw respectively, the disinfectant product from a tank to send it under pressure into the ramps 18 and 19, and a liquid fluid under pressure, such as water for example, from a buffer tank driving a turbine which constitutes the rotor of motor 32.

It should also be considered that motor 32 may be an electric motor, the feeding of which is sufficiently timed to allow the ring 3 to make at least one full turn, and is controlled by a switch which is actuated when the user operates the bowl-cleaning/flushing control.

In the case of an installation of a conventional type complete with flush-tank, operationally coupled to and carried by the bowl, or placed at a distance from said bowl, the means used for working the unit 9 and causing the conjugated feeding of the driving member 10 can be operated by the user when the latter operates the flush-tank.

Figure 10:
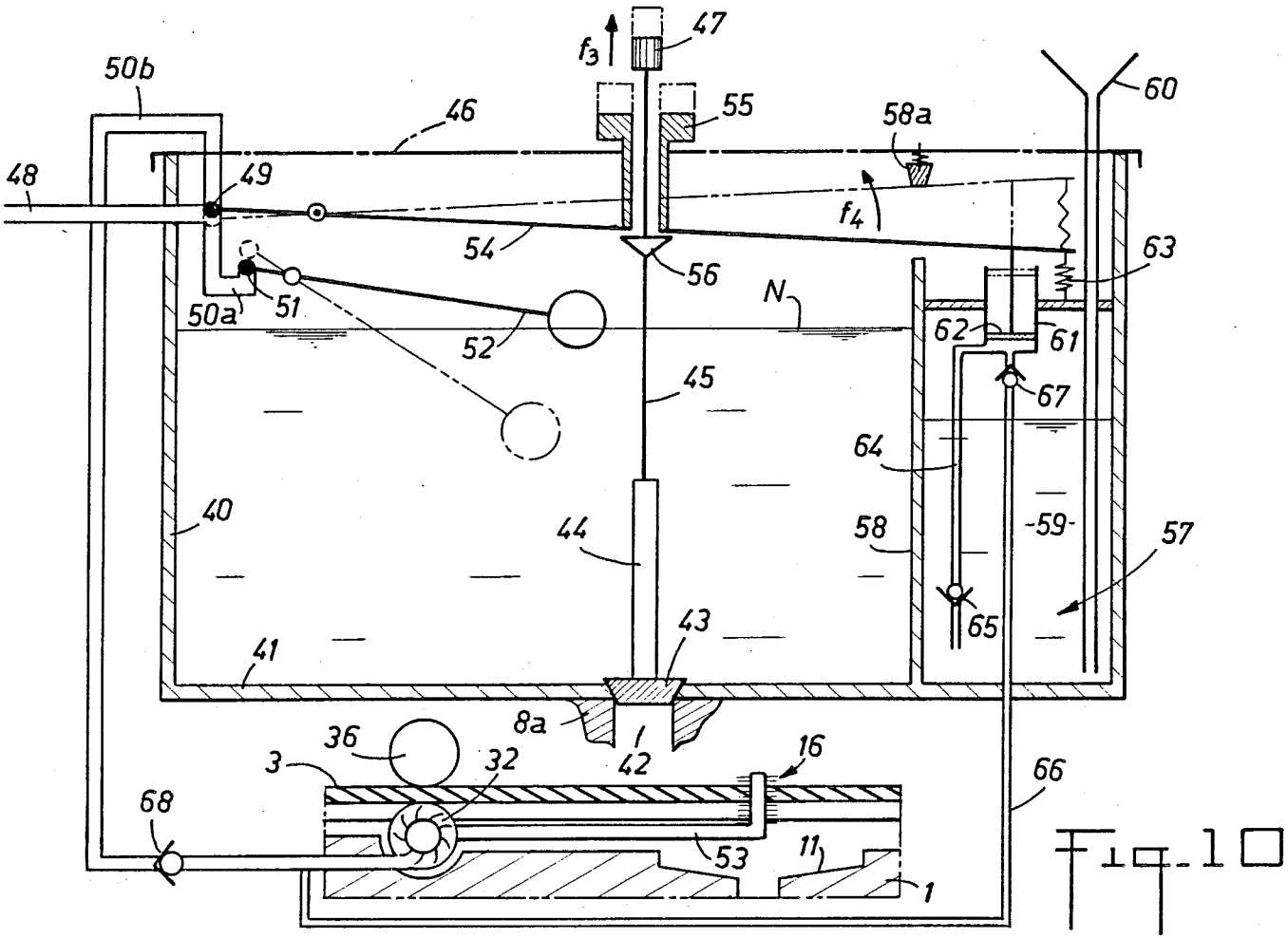
FIG. 10 is a diagrammatical view illustrating one of the elements constituting the object of the invention.

FIGS. 1 and 10 show, by way of example, such means as used in the case of a flush-tank 40 of the type to be mounted in conventional manner, to rest on the rear part 8*a* of the bowl. The bottom 41 of the tank 40 defines a drain-hole 42 placed in tight relation with the draining channel 1*a*. Said drain-hole 42 is closed off by a valve 43 forming part of an overflow closing system 44 controlled by a rod 45 raising vertically to traverse a cover 46 closing off the tank 40. Said rod 45 comprises, outside the cover 46, a knob 47 for controlling the system 44.

The flush-tank 40 is connected with a pressurized water inlet pipe 48, said pressurized water coming from any suitable source. Said water can be conveyed, via by-pass valve 49 of the type with two outlets, towards either of two branch-pipes 50*a* and 50*b*. Branch-pipe 50*a* is controlled by a valve 51 actuated by a float 52 placed inside the flush-tank 40 to determine the maximum filling level thereof. Second branch-pipe 50*b* is constituted by a by-pass pipe reaching, as in the illustrated example, to the inlet orifice of a turbine constituting the water-driven motor 32. In such a case, the outlet orifice of motor 32 is connected via a pipe 53 with ramps 18 and 19 forming the means 16 of delivering the disinfectant product (FIG. 6).

The valve 49 is controlled by a pivoting lever 54 operationally coupled to a pull member 55 traversing the cover 46. Said lever 54 rests when in inoperative state on an abutment 56, which is actuatable in one direction only, and which is provided on the rod 45 of the system 44. Preferably, the pull member 55 concentrically surrounds the rod 44.

The lever 54 has a free end portion which extends inside a container built in or made inside the flush-tank 40 by a partition wall 58. Said container 57 contains a reserve 59 of disinfectant product which can be introduced via filling pipe 60 accessible from the cover 46. Said container 57 carries a pump 61, the piston 62 of which is coupled to the end portion of the lever 54. The piston 62 is held in a delivery position inside the pump 61 by the lever 54 which is subjected to the action of a return spring 63. The pump 61 comprises a bleeding pipe 64 equipped with a non-return valve 65 sinking to the bottom of container 57. The pump 61 is extended by a delivery pipe 66 equipped with a one-way restrictor 67. Said pipe emerges, either in outlet pipe 53 of the motor 32, or in the admission pipe thereof. FIG. 10 diagrammatically shows a preferred embodiment wherein the pipe 66 is connected to the admission pipe of motor 32, in order to obtain a better mixture of the disinfectant product. In all cases, a non-return valve 68 is provided to prevent the product from diffusing upstream either into the tank or in the pipe 48.

The afore-described means for controlling the operation of the unit 9 and the conjugate feeding of the drive member 10, work as follows:

The water under pressure, brought in through pipe 48, is diverted towards branch-pipe 50*a*, considering that the valve 49 is controlled by the lever 54 urged by the return spring 63 in its resting position on the abutment 56 of the rod of the system 44 used for closing the drain-hole 42.

The water under pressure is thus directed towards the flush-tank 40 which it fills up to level N defined by adjusting the float 52. When said level is reached, the valve 51 closes off branch-pipe 50*a* and stops the admission of water.

To clean and flush the bowl, the user pulls, in the direction of arrow $f_3$, the knob 47 controlling the drain-hole, so as to open the valve 43. The flushing effect then intervenes normally, and needs not be further described here.

The pulling action, in the direction of arrow $f_3$, exerted on the knob 47, subjects the rod 45 to a rising movement, so that the abutment 56 causes the lever 54 to pivot in the direction of arrow $f_4$, subjecting the return spring 63 to a pulling force. During this pivoting movement, the piston 62 of the pump 61 is driven into a suction stroke so that a fraction 59 of the disinfectant liquid contained in container 57 is sucked up by the pump body. The quantity of product admitted can be controlled by an abutment of preset or adjustable position, such as for example, a segment 58*a* of the wall 58.

The pivoting movement of lever 54 in the direction of arrow $f_4$ also controls the valve 49 which diverts the water under pressure towards the branch-pipe 50*b*. The water under pressure is directed towards the inlet orifice of motor 32 which is then urged into rotation to cause, via the driving roller 34 and the reverse pad-roller 36, the round movement of the lavatory seat 3 on the support and guide means 2.

When the user releases pull member 47, the return spring 63 urges the lever 54 to pivot in the reverse direction to arrow $f_4$. The piston 62 then delivers progressively the fraction of liquid admitted into the pump through the pipe 66 taking said disinfectant liquid into the admission or delivery circuit of the motor 32. The presence of the one-way restrictor 67 which can be adjusted enables to time the delivery of the disinfectant product and thus to ensure its injection substantially throughout the supplying phase of motor 32.

Thus, simultaneously to its rotation, the motor 32 supplies a liquid fluid under relative pressure which includes the water and the disinfectant product distributed by the ramps 18 and 19 to the periphery of the ring 3 driven in rotation as indicated hereinabove.

Thus, by simply actuating normally the system controlling the drain-hole, the user simultaneously starts the flushing-cleaning of the bowl, as well as the supply of disinfectant product to the ramps 18 and 19 and the conjugate operation of the driving member 10 whose task is to move the lavatory seat over at least a complete turn through the cleaning and wiping unit 9. The seat 3 is thus cleaned and disinfected and ready to be used again.

If the state of the bowl remains doubtful, it is possible for the next user to conduct, before using the bowl, a cleaning and disinfecting operation on said bowl, without emptying the tank 40. In such a case, indeed, the user has to operate the control 55 in order to actuate only the lever 54, thus causing the operation of the unit 9 and the supply to drive member 10.

It should be noted that the user is also kept informed of the working condition of the cleaning device. Indeed, in the above-described type of construction, if the container 57 is empty, the pivoting movement of the lever 54 causes no admission into the pump 61. The spring then returns the lever 54 immediately in its initial position, this closing off the water supply to the motor 32. The user thus finds that the lavatory seat has not been taken on a rotation turn.

FIGS. 1 and 2 show that provision is made to mount on the plate 15, whether or not the tank 40 is carried by said plate, a removable hood 69 capable of covering up, concealing and protecting completely the cleaning unit 9 and the drive member 10. The hood 69 comprises, on its two lateral faces 70, openings 71 fitting over the seat 3 and allowing the passage thereof, whilst constituting for said seat abutments against the two coming apart unexpectedly.

The lateral walls 70 of the hood 69 can be provided on their inside face with an inlet deflector and an outlet pad surrounding the seat 3.

The hood 69 can comprise suitable locking means in order to be held firmly in a closing position, such as illustrated in FIG. 1.

It is also advantageous to design the rear portion of the bowl so that it has a front extension 72 with an upper rim 73 behind which is fitted the corresponding front edge of the hood 69. A seal can be provided between the faces in opposite relation of the hood 69 and of the rim 73 so as to prevent the disinfectant liquid from splashing. Such extension 72 may be designed so as to also form as conventionally known, a covering 74 whose function is the same as that of covering 5 described with reference to FIG. 4. The function of covering 74 may also be performed by a downward extension of the hood 69.

It is indicated in the foregoing that the cleaning unit 9 makes use of at least two spraying ramps and two cleaning pads. As a variant, the cleaning unit could comprise an application apparatus for directly applying the disinfectant product, via one or more pads, which are either movable or fixed and are permanently soaked with the product to be applied. In such a case, it is also possible to combine with said apparatus, a heating ramp and a blower in order to remove the disinfectant product by evaporation rather than by wiping. It should be noted that such heating ramp and blower can also be used in combination with the means described with reference to the preceding figures.

Figure 11:
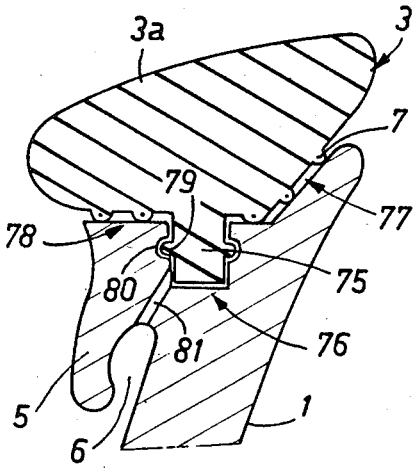
FIGS. 11 to 14 are partial cross-sections showing on a larger scale four different embodiments of the elements constituting the object of the invention.

FIG. 11 shows another embodiment wherein the seat 3 is in the form of a closed ring 3*a* in likewise closed cross-section, as opposed to the open "C" cross-section of the example illustrated in FIG. 3. Such a ring is preferably in alveolar plastic material coated with a compact outerskin, so as to present improved properties of comfort. The ring 3*a* comprises, on its lower face, a molding 75 which is engaged, by local elastic deformation, inside an annular groove 76 provided in the upper rim of the bowl. Preferably, said rim defines an external lateral part 77 which is inclined towards the bottom of the groove 76, from the outer peripheral surface of the bowl and an inner lateral part 78 joined to the aforedescribed covering 5.

Preferably, the portions of peripheral surface of the ring 3*a* which cooperate with the supporting parts 77 and 78, are provided with ribs 7 designed to limit friction.

The annular groove 76, as well as the parts 77 and 78 constitute together the means 2 supporting and guiding the seat 3.

Preferably, means are provided to cause the relative transversal immobilization between the ring 3*a* and the means 2. Said immobilization means are for example, formed by one or more ridges 79 projecting from the substantially vertical faces of the molding 75. Said ridges are designed to cooperate with complementary flutes 80 presented by the opposite faces of annular groove 76.

Parts 77 and 78 also act as a draining channel for any drops or traces of water that may be left on the surface of the ring 3*a*, said water being thereafter directed towards the inside of the bowl. It is possible, to this end, to provide holes 81 on the bottom of the annular groove 76, which holes issue into the bowl and connect said annular groove with the draining channel 6.

Figure 12:
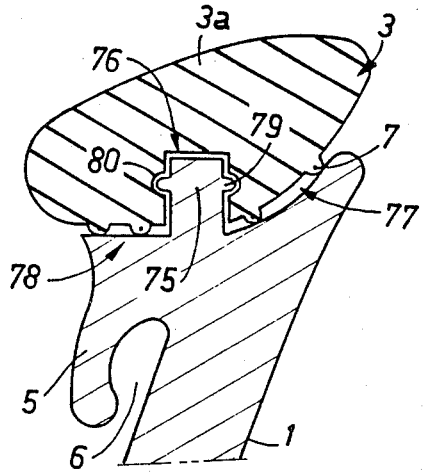

FIG. 12 illustrates a variant wherein the ring 3a defines, on its lower face, the annular groove 76, whereas the molding 75 is formed substantially from the upper rim of the bowl. In such a case, said upper rim defines the parts 77 and 78. The means of relative transversal immobilization are then used as those used in the case according to FIG. 11.

Figure 13:
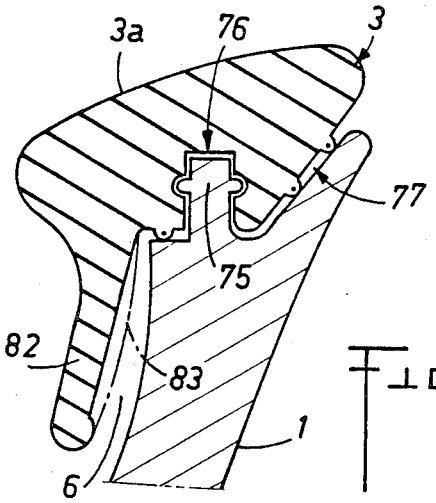
Figure 14:
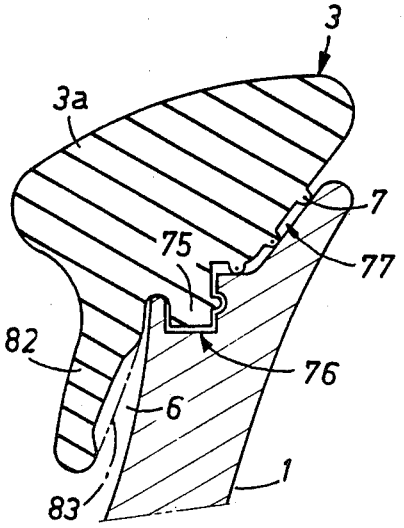

FIGS. 13 and 14 illustrate two other embodiments using the same means to constitute the support and guide as described with reference to FIGS. 11 and 12, namely the annular groove 76, molding 75, support surfaces 77 and 78, ridges 79 and flutes 80. But, in these two variants, the covering 5 is replaced by a lip 82 formed by a downward projecting part of the ring 3a. The lip 82 has the same function as the covering 5 and also contributes to defining the draining channel 6. The advantage of this particular embodiment is to procure, if necessary, a complete and thorough cleaning of the bowl, seeing that the release of the ring gives direct access to the surface defining the draining channel 6.

Figure 15:
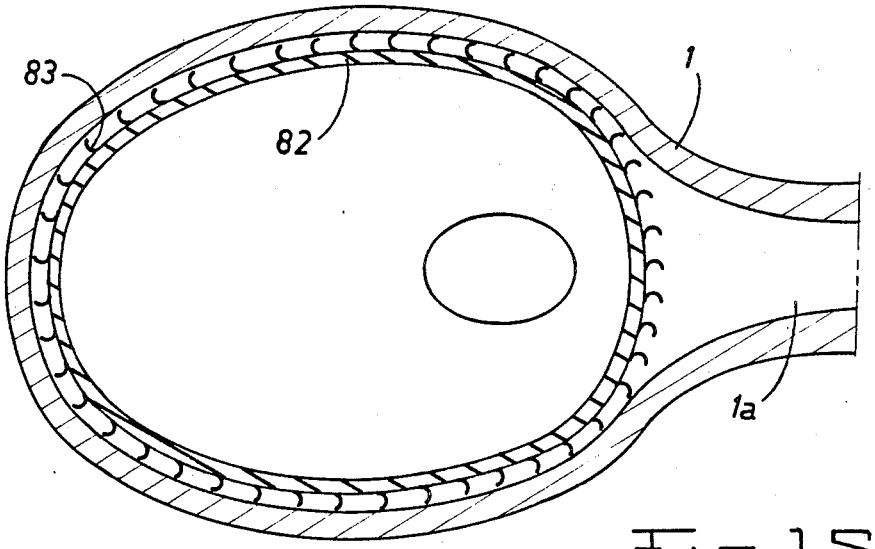
FIG. 15 is a partial cross-section illustrating one detail particular to the embodiments shown in FIGS. 13 and 14.

In the case of the embodiment illustrated in FIGS. 13 and 14, it may also be advantageous to bring, over the whole peripheral inner surface of the lip 82, blade-shaped projections 83 (FIG. 15). Under the action of the water admitted through the flowing channel 1a, said blades 83 contribute to driving the seat 3 in relative movement on the support and guiding means 2 provided on the seat 1.

In the embodiment illustrated in FIGS. 11 to 14, there may be a possibility to modify the driving member 10 so that it comprises only a driving roller 34. The periphery of said roller may be grooved so as to cooperate positively with notches or teeth forming a continuous rack design on one of the faces of the ring 3a and more particularly on one of the faces defining either the annular groove 76 or the molding 75.

In such a case, it is also possible to place the driving member in another part than in the preceding case.

Figure 16:
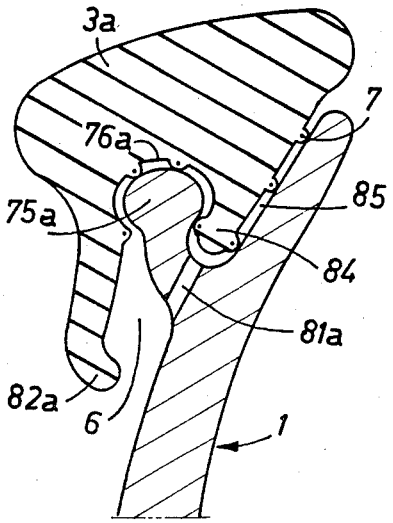
FIG. 16 is a similar view to those shown in FIGS. 11 to 14 and illustrates a preferred embodiment of some of the elements constituting the object of the invention.

FIG. 16 can be considered as being the preferred embodiment wherein the ring 3a defines a housing or groove 76a, of substantially semi-circular cross-section, at least equal to that of a molding 75a provided on the upper rim of the bowl extending from the inner face thereof. Said groove 76a is bordered, on the one hand, by the lip 82a and, on the other hand, by a projecting shoulder 84 which is engaged in a guiding space 85 provided between the molding 75a and the thickness of the wall of the bowl 1.

This particular embodiment makes production easier and because of the conjugated complementary profiles it enables to achieve a correct support of the ring 3a as well as a transversal relative immobilization by the gripping action exerted on the molding 75a by the lip 82a and the shoulder 84. As in the embodiment illustrated in FIG. 11, holes 81a are provided between the bottom of space 85 and the inner wall of the bowl, to help drain the latter from any water or disinfectant product running or dripping on its surface.

The invention is in no way limited to the examples described hereinabove and on the contrary covers any modifications that can be brought thereto without departing from its scope. In particular, the cleaning-disinfectant fluids can be collected into small basins in order to be directed towards storage tanks. It may also be provided to fit a hinged cover on the hood 69 or else on supports rising from the rear portion 8. Likewise, the disposition of the motor 32 and of the reverse roller-pad 36 could be reversed.

What is claimed is:

1. A toilet bowl and seat unit with automatic cleaning means for the seat, said bowl having a support and guiding means, an annular seat mounted for rotation on said guiding means, a driving means mounted on said bowl for driving said annnular seat and a cleaning and disinfecting unit mounted on said bowl for cleaning and disinfecting said annular seat, comprising:

said bowl having a back portion and an annular upper rim forming said guiding means in the shape of an upstanding flange portion which provides locally an interrupted zone in a part substantially corresponding to the back portion of the bowl, said seat formed by a closed ring having an upper surface and a lower surface, said lower surface offering a structure complementary to said support and guiding means on which said ring is slidably rotably mounted, at least one small upwardly opened basin presented by said back portion of the bowl in said interrupted zone, said basin communicating with a draining channel issuing into said bowl, a cleaning unit for the whole surface of said ring, said cleaning unit being situated on the back portion of the bowl and in the interrupted zone of said support and guiding means to be at least partly over said opened basin, a driving means mounted on said back portion of said bowl in said interrupted zone and provided to cause said ring to slide over and through said interrupted zone and said cleaning unit, and means for controlling the temporary working of said cleaning unit, and the conjugated supply of said driving means in order to cause the sliding of said ring with respect to said cleaning unit over at least a complete round.

2. Lavatory unit as claimed in claim 1, wherein said cleaning unit comprises means for dispensing by spraying a disinfectant product and means for wiping said product.

3. Lavatory unit as claimed in claim 2, wherein said means for dispensing a disinfectant product is formed by ramps and said means for wiping is formed by pads, said ramps and said pads comprising for each one a fixed element and a movable element.

4. Lavatory unit as claimed in claim 3, wherein said ramps and said pads are disposed substantially radially with respect to said ring and are placed above at least one opened basin.

5. Lavatory unit as claimed in claim 2, wherein said driving means comprises, on the one hand, a motor the output shaft of which carries a driving roller and, on the other hand, a reverse pad-roller pressing locally onto the upper surface of said ring traversing said interrupted zone.

6. Lavatory unit as claimed in claim 1, wherein said driving means is of a type working with water and has a supplying circuit for said water and wherein said cleaning unit comprises a storage tank for the disinfectant product, said storage tank being connected to said supplying circuit.

7. Lavatory unit as claimed in claim 6, wherein said storage tank is a flush tank having a control and being operationally coupled to said bowl and said control ensuring when operated the operation of said cleaning unit and said driving means.

8. Lavatory unit as claimed in claim 6, wherein said supplying circuit of said driving means is taken from a supplying circuit for the flush tank, said later supplying circuit having a by-pass valve actuated by the control of said flush tank.

9. Lavatory unit as claimed in claim 6, wherein said flush-tank defines an inner container containing a disinfectant product and supporting a regulating pump the outlet of which being connected to said supplying circuit of said water operated motor, said pump being operated synchronously with the operation of said water-operated motor.

10. Lavatory unit as claimed in claim 9, wherein said flush-tank comprises a water inlet pipe having a by-pass valve with outlets one of which is connected to the input of said water-operated motor while the other leads to a valve controlled by a float indicating the level of said flush-tank, said valve being controlled so as to connect the water inlet pipe with the water-operated motor input by a pivoting lever with elastic return means, said lever being operated by a pull member accessible from the flush-tank and simultaneously actuating said regulating pump.

11. Lavatory unit as claimed in claim 10, wherein said pull member is placed concentrically to a member for controlling a drain-hole of said flush-tank, said member comprising means for actuating unidirectionally said lever during the displacement of said member controlling drainage of said flush-tank.

12. Lavatory unit as claimed in claim 1, wherein said driving means and said cleaning unit are carried by a plate placed on said back portion of said bowl and are covered by a protective hood surrounding part of said ring on either side of said interrupted zone so as to form abutments opposing any disconnection of said ring, said hood cooperating with a complementary shape of said bowl in order to form a joint separating said bowl from the inside of said hood.

13. Lavatory unit as claimed in claim 12, wherein said hood has parts covering up said ring and being coupled to an inlet diverting means and to an outled pad.

14. Lavatory unit as claimed in claim 12, wherein said hood comprises, opposite to the back portion of the bowl, a part forming a corresponding part of an anti-projection covering.

15. Lavatory unit as claimed in claim 1, wherein said ring is provided on its face cooperating with the support and guiding means with sliding ribs.

* * * * *